United States Patent [19]

Catlett

[11] 4,064,924

[45] Dec. 27, 1977

[54] TRAFFIC DOOR

[75] Inventor: John C. Catlett, Milwaukee, Wis.

[73] Assignee: Kelley Company, Inc., Milwaukee, Wis.

[21] Appl. No.: 644,053

[22] Filed: Dec. 24, 1975

[51] Int. Cl.[2] ..... A47H 23/00

[52] U.S. Cl. ..... 160/354; 49/9; 49/482; 49/488; 49/368; 52/499

[58] Field of Search ..... 49/488, 366–368, 49/460, 482, 9, 34, 383, 388; 160/354, 327; 52/499–501, 476, 397, 628, 716

[56] References Cited

U.S. PATENT DOCUMENTS

| | | | |
|---|---|---|---|
| 2,642,164 | 6/1953 | McLean | 49/488 X |
| 2,688,164 | 9/1954 | Nelson | 49/460 X |
| 3,038,217 | 6/1962 | Harris | 49/482 X |
| 3,112,817 | 12/1963 | Critchfield | 49/488 X |
| 3,295,589 | 1/1967 | Pfleger et al. | 160/327 |
| 3,391,723 | 7/1968 | Kirby | 160/206 |
| 3,455,080 | 7/1969 | Meadows | 52/628 X |
| 3,468,064 | 9/1969 | Fraleigh et al. | 49/488 X |
| 3,652,380 | 3/1972 | Strack | 52/397 X |
| 3,662,493 | 5/1972 | Foltz | 49/388 |
| 3,854,246 | 12/1974 | McAllister | 49/488 X |
| 3,858,357 | 1/1975 | McGuire | 160/354 X |

*Primary Examiner*—Philip C. Kannan

*Attorney, Agent, or Firm*—Andrus, Sceales, Starke & Sawall

[57] ABSTRACT

A traffic door biased to the closed position and adapted to be swung to the open position when pushed manually or engaged by material handling equipment. The traffic door includes an inverted L-shaped frame and a spring loaded cam mechanism is associated with the upper horizontal frame section of the frame and acts to bias the door to the closed position. Both the vertical and horizontal frame sections include a hollow rail having longitudinal recesses in opposite edges. The door panels are secured within the inner recesses of the rails by wedge-shaped strips, while channel members are secured in the outer recesses and carry a pair of weather strips which engage the jamb and header of the doorway. The outer vertical edge of each door panel is clamped within an edge seal strip which includes an outer flexible hinge section and a pair of arms having teeth or serrations which are clamped to opposite faces of the respective panel. Each edge seal strip has cooperating male and female locking elements with ratchet type teeth which maintain the arms of the strip in locking engagement with the panel.

7 Claims, 8 Drawing Figures

TRAFFIC DOOR

BACKGROUND OF THE INVENTION

Traffic doors are two-way swinging doors commonly used in industrial and commercial establishments. The doors are normally biased to the closed position and can be swung to the open position either manually or by engagement with material handling equipment, such as a fork lift truck.

A traffic door of the type shown in United States Pat. No. 3,295,589 includes an inverted L-shaped frame which is hinged to the doorway to swing in either direction, and the frame carries a lower impact resistant panel and an upper transparent panel. A spring loaded cam mechanism is associated with the upper horizontal frame section of the frame and acts to bias the door to the closed position. When the lower panel is engaged by the material handling equipment, the door is swung to the open position against the force of the spring loaded cam mechanism and after the equipment has passed through the doorway, the door is automatically returned to the closed position by the spring biasing force.

Traffic doors must necessarily be of strong rugged construction in order to withstand the impact of material handling equipment, and the surfaces of the door panels must be free of obstructions so that the material handling equipment will not catch or hang up on any portion of the door as it moves through the doorway.

As the doors are frequently used to separate areas of different temperature, it is also important that the doors provide a good weather seal. When used in certain types of commercial establishments, it is also desirable that the traffic door have an attractive appearance with a minimum of exposed fasteners or hardware.

SUMMARY OF THE INVENTION

The invention relates to an improved traffic door construction which includes an inverted L-shaped frame including an upper horizontal frame section and a vertical frame section. The vertical section is mounted for pivotal movement about a vertical axis by self-aligning bearing assemblies which are located at the upper and lower ends of the vertical section. The door is urged to the closed position by a spring loaded cam assembly including a generally heart-shaped cam mounted on the jamb and a spring loaded follower that rides on the cam and is located in the upper frame section.

Both the vertical and horizontal frame sections are composed of hollow rails having an outer longitudinal recess facing the jamb or header and an inner longitudinal recess facing in the opposite direction. A channel-shaped strip is clamped within each outer recess and carries a pair of weather strips that engage the jamb or header to provide a weather seal between the door and the doorway.

Door panels are secured within the inner recesses of both the vertical and horizontal rails by wedge-shaped clamping strips. Each clamping strip has serrations or teeth which engage opposite faces of the panel, and as the strip is moved inwardly of the recess the tapered surfaces on the strip cooperate with inclined surfaces on the rail to wedge the strip tightly against the panel.

The free vertical edge of the door panel carries a sealing strip adapted to engage a similar strip of a cooperating door. Each sealing strip has a generally U-shaped configuration, and is provided with a flexible hinge section and a pair of substantially rigid arms. The arms are provided with serrations or teeth which are adapted to engage opposite surfaces of the door panel to clamp the strip to the panel.

To lock the edge sealing strip to the door panel, male and female locking elements are incorporated with the arms of the strip, and the locking elements have cooperating ratchet-type teeth which lock the arms in tight bearing engagement with the panel.

The traffic door of the invention has a more attractive appearance than traffic doors used in the past, in that there are fewer exposed fasteners and all of the operating elements are concealed within the vertical and horizontal rails. As a further advantage, the door is symmetrical about the pivot axis thereby reducing the stress on the bearing assemblies and facilitating installation of the door.

The door panels are connected to the rails through a gripping mechanism which extends the entire length of the rails and this is an improvement over prior art traffic doors in which the panels were connected at spaced intervals to the rails, thereby causing stress concentrations at the locations of attachment.

The sealing strips, which are associated with the free vertical edges of the doors, tightly engage each other when the doors are in the closed position to provide a complete weather seal between the doors, and this eliminates the necessity of employing overlapping door panels as has been used in prior types of traffic doors.

Various types of door panels can be utilized with the door construction of the invention depending on the specific installation. The panels can include opaque impact resistant panels, transparent plastic panels, double insulated transparent panels, and the like.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
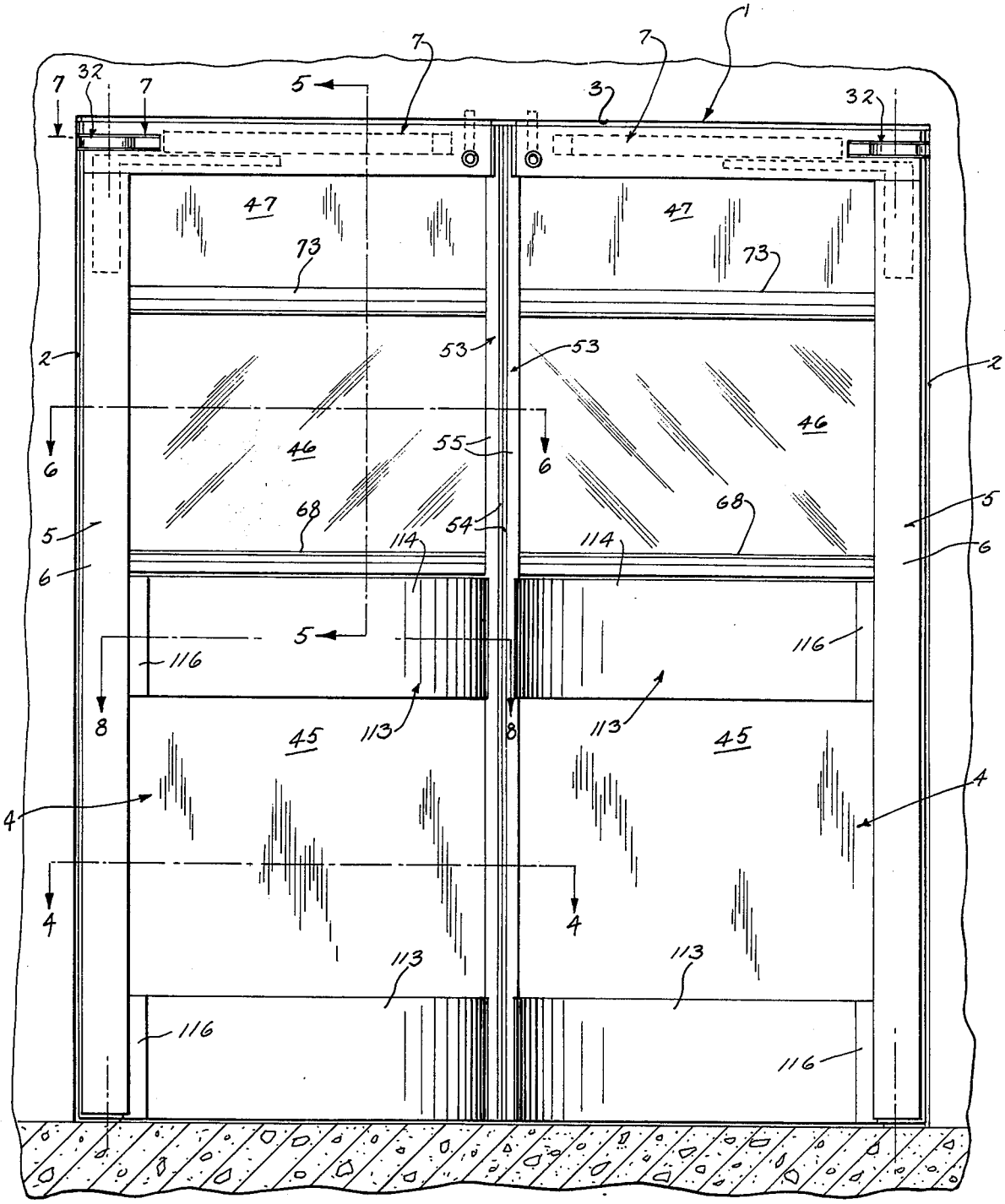
FIG. 1 is a plan view of the traffic door of the invention as installed in a doorway.

FIG. 1 illustrates a doorway 1 in a commercial or industrial building defined by a pair of vertical door jambs 2 and a horizontal header 3. A pair of traffic doors 4 are mounted in the doorway 1 to swing in either direction from a closed position.

Figure 3:
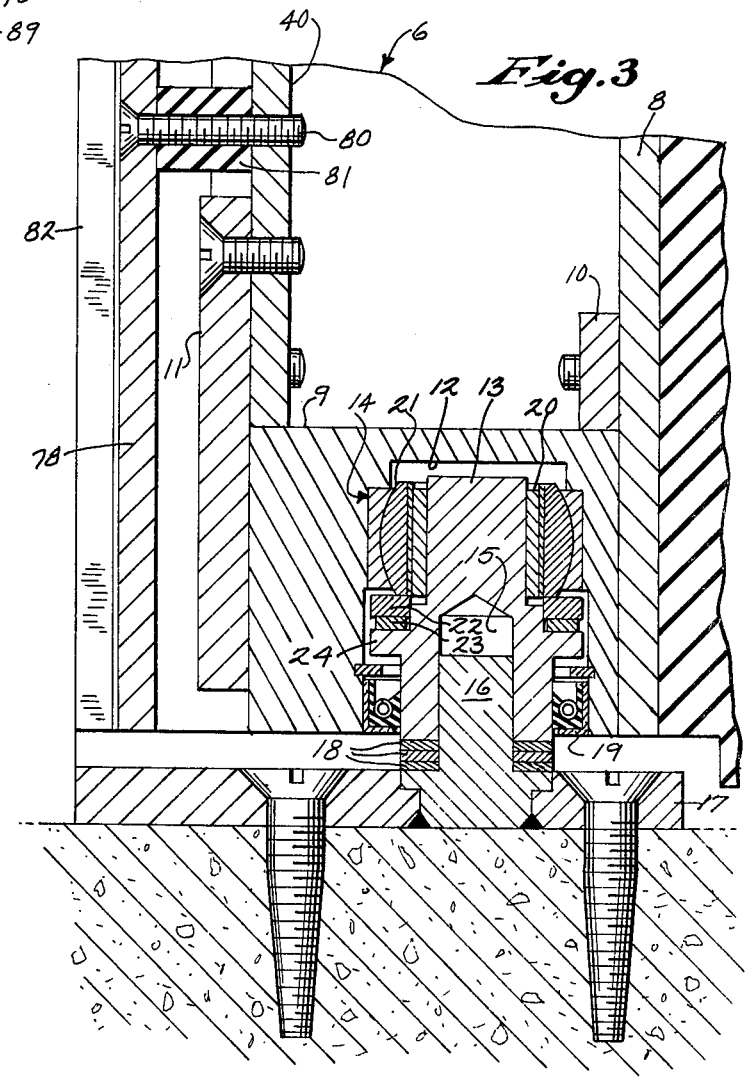
FIG. 3 is a fragmentary vertical section showing the lower portion of the vertical frame section.
Figure 4:
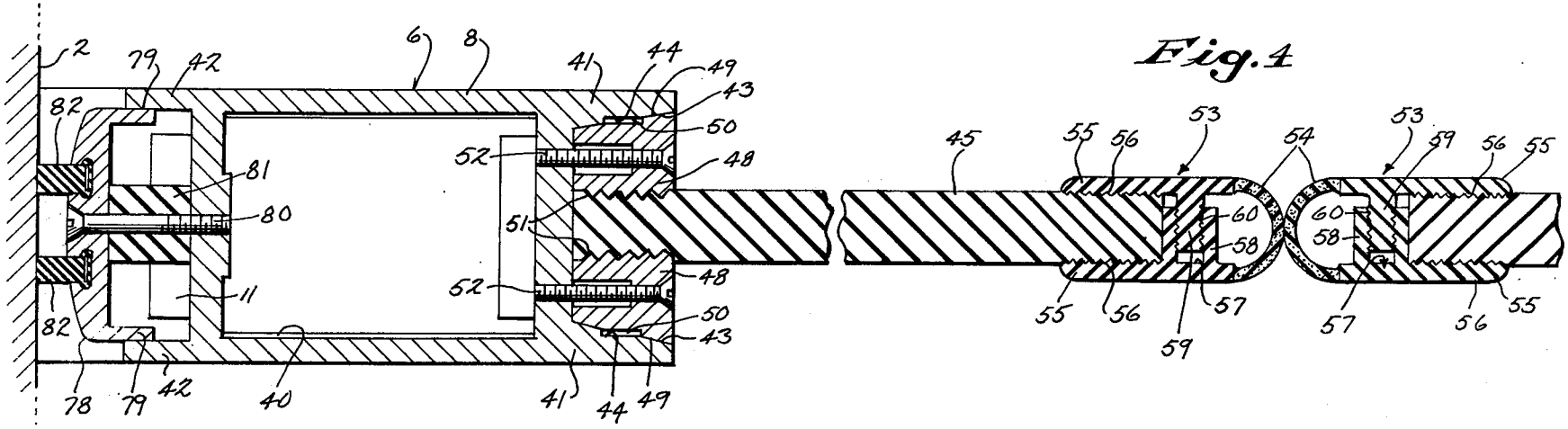
FIG. 4 is a section taken along line 4—4 of FIG. 1.

Each traffic door 4 includes an inverted L-shaped frame 5 composed of a vertical frame section 6 and an upper horizontal frame section 7. As best shown in FIG. 4, the vertical frame section 6 comprises a generally box-shaped rail 8 which can be formed of an aluminum extrusion, and the lower end of rail 8 is secured to a block 9, as illustrated in FIG. 3. To provide this connection, a pair of plates 10 and 11 are secured to the block 9 and the plates are connected to the rail 8 by suitable screws.

Block 9 has a central recess 12 and is journaled for pivotal movement about a sub-shaft 13 by a self-aligning bearing assembly indicated generally by 14.

As shown in FIG. 3, shaft 13 is provided with a central bore 15 which receives an upstanding pin 16 secured to base plate 17 that is mounted on the floor of the building. One or more shims 18 can be positioned between the plate 17 and the lower end of the shaft 12 to adjust the position of the shaft 12 vertically. A sealing assembly 19 is located between the wall of the recess 12 and shaft 13 and serves to provide a seal for the bearing assembly 14.

The bearing assembly 14 includes a series of needle bearings 20 which are mounted on the upper end of the shaft 12 and are located within a self-aligning bushing 21 secured within a groove in the block 9. The self-aligning bushing 21 bears against a thrust washer 22 and thrust bearings 23 which engage an annular shoulder 24 formed on the shaft 13. With this construction, the bushing 21, thrust washer 22 and thrust bearing 23 are carried by the block 9 and are adapted to rotate with respect to the fixed stub shaft 12 and pin 16.

To mount the upper end of the rail 8 for rotation, a T-block 25 is connected within the upper end of the rail 8, and the upper end of the block 25 is secured to the underside of a channel 26 which constitutes a portion of a horizontal frame section 7. The T-block 25 and channel 26 are secured together by a connecting plate 27 and bolts 28.

Figures 2, 8:
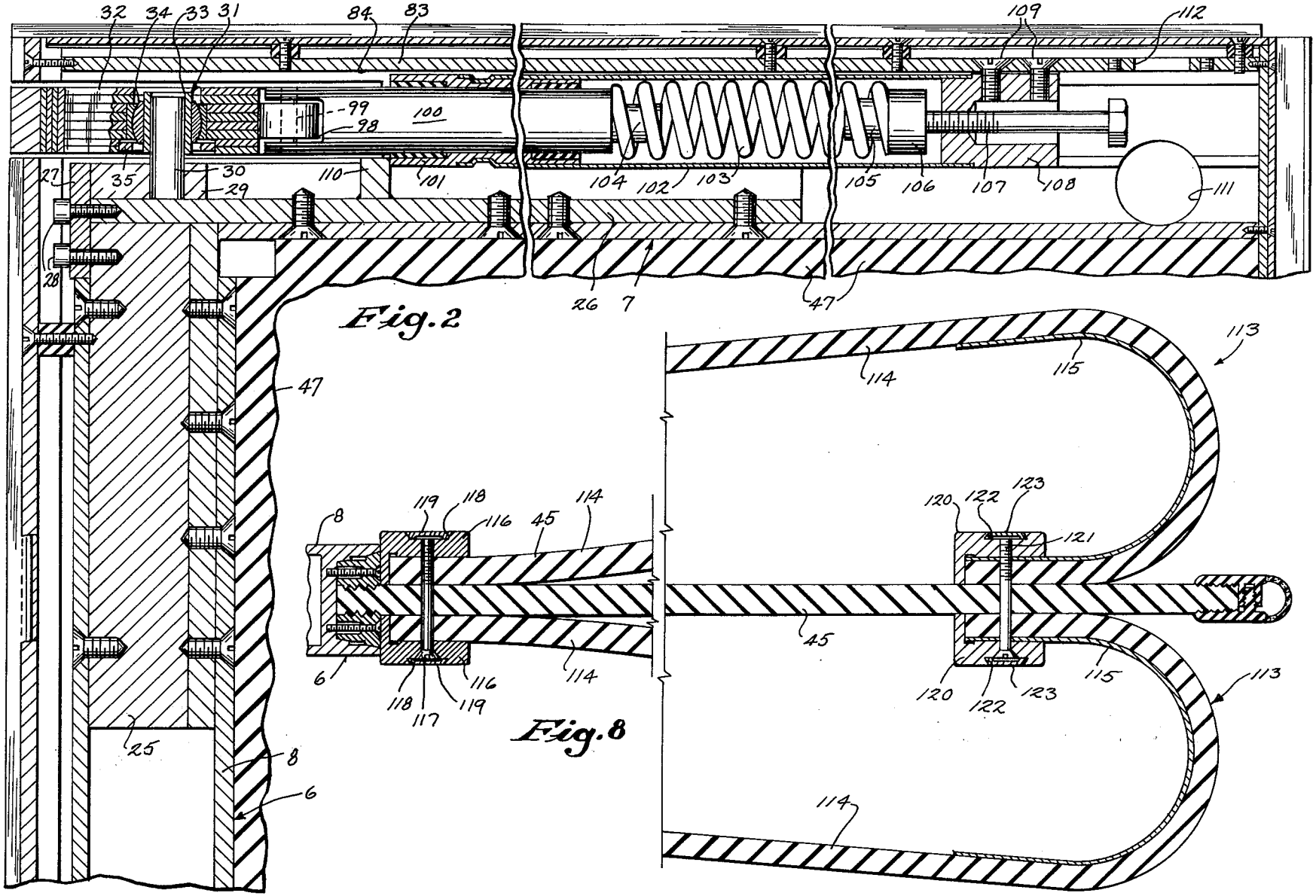
FIG. 2 is an enlarged vertical section showing the upper frame section.
FIG. 8 is a view taken along line 8—8 of FIG. 1, and showing the bumper construction that can be utilized with the door.

As shown in FIG. 2, a block 29 is mounted within the inner end of the channel 26 and pin 30 extends upwardly from the block and is journaled within a self-aligning bearing assembly 31 which is mounted within an opening in cam 32 laminated from metal strips.

The self-aligning bearing assembly 31 includes a series of needle-bearings 33 which are secured to the pin and rotate within a self-aligning bushing 34 secured within a recess in cam 32 by locker washer 35.

Figure 7:
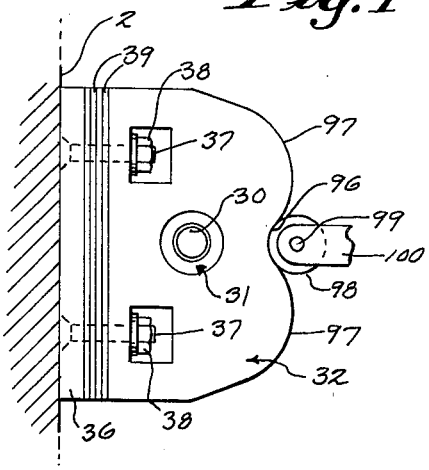
FIG. 7 is a section taken along line 7—7 of FIG. 1; and showing the cam construction.

As illustrated in FIG. 7, the cam 32 is secured to the jamb 2 of the doorway through a mounting plate 36. Bolts 37 extend outwardly from the mounting plate through openings in the cam and the outer ends of the bolts receive nuts 38 which are disposed within cavities in the cam. One or more spacers 39 can be utilized to properly space the cam 32 from the jamb 2 so as to obtain vertical alignment of pin 30 with pin 16.

The self-aligning bearing assemblies which are utilized at both the upper and lower ends of the door compensate for misalignment in the mounting of the door, thereby reducing the load on the bearings and enabling bearings of smaller capacity to be employed.

The vertical rail 8 has a generally box-shaped configuration with a central opening 40, and includes a pair of spaced flanges 41 which extend toward the center line of the doorway and a pair of spaced flanges 42 which project toward the jamb 2. Each flange 41 is provided with an inclined or sloping surface 43 which is interrupted by a notch or groove 44.

The rail 8 is adapted to carry three separate panels 45, 46 and 47. The lower panel 45 is constructed of a flexible impact resistant material, such as rubber or plastic, and is adapted to be engaged by material handling equipment as the same passes through the doorway. The central panel 46 is normally composed of a transparent plastic material which enables the operator of the material handling equipment to see through the door as he is approaching the doorway. As in the case of the lower panel 45, the upper panel 47 is normally composed of a flexible rubber-like material.

As best illustrated in FIG. 4, the lower panel 45 is connected to the rail 8 by a pair of clamping strips 48. Each clamping strip has an inclined surface 49 interrupted by a notch 50, and the inclined surfaces 49 are adapted to ride against the inclined surfaces 43 of the rail as the strips 48 are attached. Each strip is provided with a series of serrations or teeth 51 which are adapted to engage the respective faces of the lower panel 45, as shown in FIG. 4.

The clamping strips 48 are secured to the rail 8 by a series of screws 52 and as the screws are tightened down, the cooperating surfaces 43 and 49 act to wedge the strips inwardly toward the panel to provide a tight engagement between the strips and the panel. The notches 44 and 50 serve to reduce the frictional resistance as the strips 48 are wedged inwardly.

The edge of the panel 45 located along the center line of the doorway carries a sealing strip 53 and, as shown in FIG. 4, the sealing strips of both doors are adapted to be engaged, when the doors are closed to provide a weather seal along the center line of the doorway.

Each sealing strip 53 is generally U-shaped in cross section and includes a flexible web or hinge section 54 and a pair of substantially rigid arms 55 which extend outwardly from the hinge section 54. The inner surface of each arm 55 is provided with a series of teeth 56 which engage opposite faces of the lower panel 45 and the teeth 56 are locked in engagement with the faces of the panel by a locking unit indicated generally by 57. Locking unit 57 includes a female locking element 58 and a cooperating male element 59 both of which have cooperating ratchet-type teeth 60. Engagement of the ratchet teeth 60 will prevent the arms from being spread apart to thereby maintain the tight engagement of the sealing strip 53 to the edge of the panel.

Figure 6:
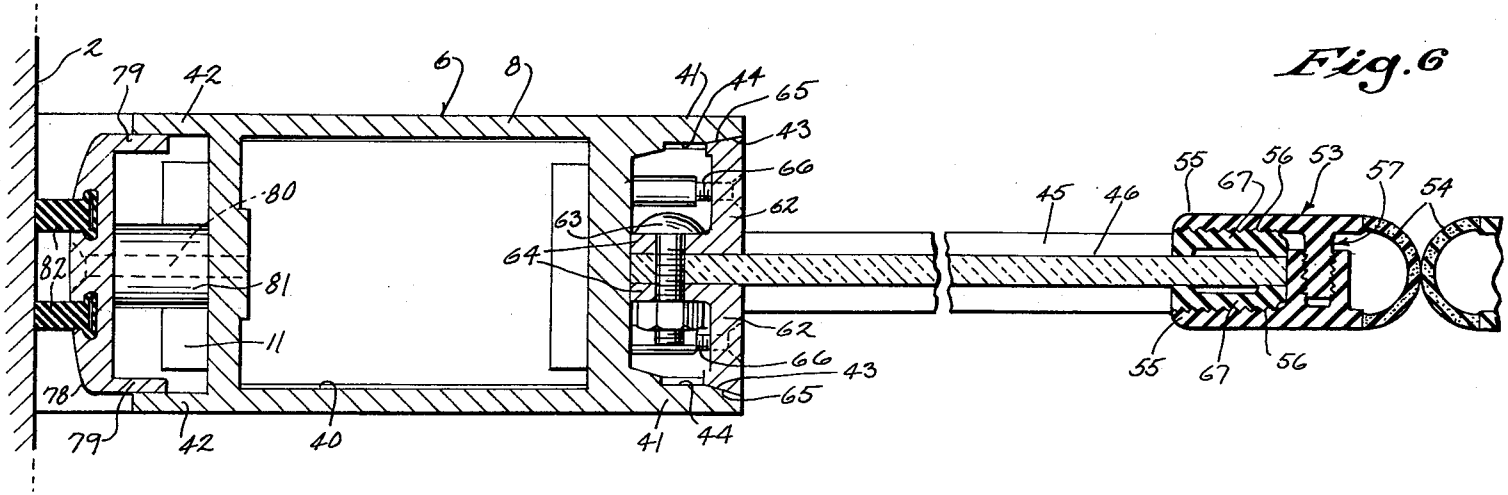
FIG. 6 is a section taken along line 6—6 of FIG. 1.

The connection of the central transparent panel 46 to the rail 8 is illustrated in FIG. 6. The panel 46 is secured to the rail through use of a pair of L-shaped clamping strips 62 which are located on opposite sides of the panel and are connected to the edge of the panel by bolts 63 which extend through aligned openings in the panel and the legs 64 of the strips 62. Each of the clamping strips 62 includes an inclined surface 65 which is adapted to ride against the inclined surface 43 of the flange 41 as the connecting screws 66 are tightened down.

As illustrated in FIG. 6, a pair of generally U-shaped strips 67 are secured to the vertical edge of the transparent central panel 46, and the clamping arms 55 of the sealing strip 53 engage the strips 67 to thereby clamp the strip 53 to the central panel 46.

Figure 5:
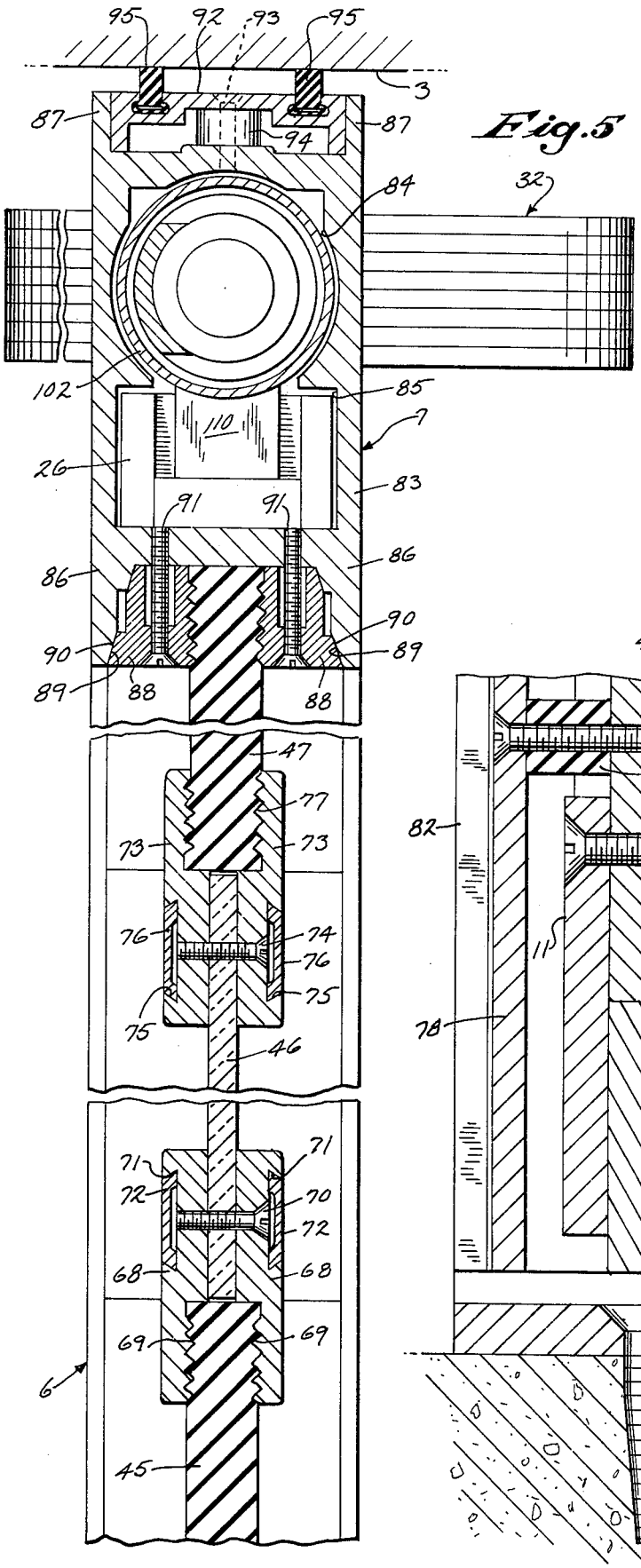
FIG. 5 is a section taken along line 5—5 of FIG. 1.

The upper edge of the lower panel 45 is attached to the lower edge of the central panel 46 by a pair of connecting strips 68, as shown in FIG. 5. Each strip 68 is provided with a series of teeth or serrations 69 which engage the upper edge of the lower panel 45, and the upper portions of the strips are attached to the lower edge of the central panel 46 by means of screws 70 which extend through aligned holes in the strips 68 as well as the panel. The heads of the screws are disposed within recesses 71 and cover strips 72 which are located within the recesses 71 mask the screws 70.

The upper edge of the central panel is connected to the lower edge of the upper panel 47 in a similar manner. As shown in FIG. 5, a pair of connecting strips 73, similar to strips 68, are attached to the upper edges of the central panel 46 by screws 74. The heads of the screws 74 are located within recesses 75 which are enclosed by cover strips 76. The upper ends of the string 73 are provided by teeth 77 which engage the lower edge of the upper panel 47 as shown in FIG. 5.

The vertical edge of the upper panel 47 is connected to the sealing strip 53 in the same manner as that described with respect to the lower panel 45.

As illustrated in FIG. 4, a channel 78 is mounted between the flanges 42 of rail 8 of each door, with the flanges 79 of channel 78 being located inwardly of the flanges 42. A series of screws 80 serve to attach the channel 78 to the rail 8 and each screw extends through a resilient rubber-like block 81 located between the channel and the rail. A pair of weather strips 82 are mounted within grooves in the outer surface of the channel 78 and are adapted to bear against the respective jamb 2 to provide a weather seal.

The rubber-like blocks 81, in conjunction with screws 80, provide a means for adjusting the position of the channel 78 with respect to the rail 8, to thereby adjust the position of the weather strips 82.

As illustrated in FIG. 5, the upper horizontal frame section 8 includes a box-like upper rail 83 having an upper generally cylindrical passage 84 and a lower generally rectangular passage 85 which communicates with passage 84. The lower edge of the upper rail 83 is provided with a pair of spaced, downwardly extending flanges 86 while the upper end of the rail 83 is formed with a pair of upwardly extending flanges 87.

The upper edge of the upper panel 47 is secured to upper rail 83 by a pair of clamping strips 88, similar in construction to the clamping strips 48. Each strip 88 is provided with an inclined surface 89 which cooperates with an inclined surface 90 on the flange 86, and as the strips 88 are moved inwardly as screws 91 are turned down, the wedging action tightly clamps the panel 47 to the upper rail 83.

A channel 92, similar to channel 78 is located between the upper flanges 87. Channel 92 is secured to upper rail 83 by a series of screws 93 which extend through resilient blocks 94, similar to blocks 81. A pair of weather strips 95 are disposed within grooves in the upper surface of the channel 92 and are adapted to engage the header 3 of the doorway to provide a weather seal.

The doors 4 are each urged to the close position by a spring loaded cam assembly, which includes the cam 32. As best shown in FIG. 7, the cam 32 is provided with a central notch or recess 96 bordered by a pair of generally curved lobes 97. A follower 98 is adapted to ride on the surface of the cam and the follower is journaled on a vertical pin 99 mounted within the bifurcated end of arm 100 which is located within the passage 84 of upper rail 83. As shown in FIG. 2, the arm 100 is mounted for sliding movement within a sleeve 101 secured within the end of a tube 102 which extends through a substantial portion of the length of rail 83. A spring 103 acts to urge the follower 98 into engagement with the cam 32, and one end of the spring 103 is disposed around a pin 104 extending outwardly from the end of arm 100 while the opposite end of the spring is positioned around a pin 105 on spring seat 106.

As shown in FIG. 2, a threaded rod 107 is attached to the spring seat 106 and is threaded within opening in cap 108 which is secured within the end of the passage 84 by a series of screws 109. Tube 102 is secured to cap 108. By adjustment of the rod 107, the force of the spring 103 acting on the follower 108 can be adjusted.

To properly position the spring assembly, a stop 110 is positioned within the channel 26 and when the spring assembly is inserted within the passage 84, the ends of the tube 102 and sleeve 101 will engage the stop 110 to position the spring assembly within the upper rail.

As the door is swung to the open position, as it is either pushed manually or engaged by material handling equipment, the follower 98 will ride on one of the cam lobes 97. When the force on the door is released, the force of the spring 103 acting on the follower 98 will move the follower along the surface of the lobe and return the follower to the central notch 96. Thus, the spring acts to bias the door to the closed position, as shown in FIG. 4.

It is contemplated that the cam 32 may be designed with a shape to hold the door in the full open position, and thus the shape of the cam depends on the requirements for the particular installation.

The upper rail 83 is provided with an access opening 111 and a hole 112 in the upper surface which can receive a dead bolt for locking the door in the closed position. Through use of the access opening 111 the operator can move the dead bolt, not shown, between the locked and unlocked position.

While the drawings illustrate the traffic door utilizing a pair of resilient panels 45 and 47 and a transparent panel 46, it is contemplated that various types of panels can be utilized. In certain situations where the doors may be used to separate areas of different temperatures, double transparent panels can be used to avoid the build-up of condensation on the panels.

The traffic door of the invention can also include a pair of bumper assemblies indicated generally by 113. The bumper assemblies are adapted to be engaged by the material handling equipment and thereby minimize the impact applied to the door itself. As shown in FIG. 8, each bumper assembly 113 includes a flexible bumper 114 which is provided with a reverse bend so that the strip bows outwardly from the surface of the panel. Each bumper is formed of an outer strip of resilient rubber-like material, and a metal backing strip 115 is attached to the bent portion of the bumper. One end of strip 114 is connected between a pair of L-shaped clamping blocks 116 by a screw 117. The ends of the screws are located in recesses 118 and are enclosed by cover strips 119.

Similarly, the opposite bent end of each bumper 114 is clamped between L-shaped clamping blocks 120 by screw 121. The ends of the screws are disposed within recesses 112 and are enclosed by a cover plate 123.

The traffic door of the invention has a more attractive appearance than prior art traffic doors in that the door has a minimum of exposed fasteners or operating hardware, thereby making the door more suitable for certain types of commercial establishments.

The traffic door also has an improved weather seal in that weather strips are located around the entire periphery of the doors and engage both the jambs and header of the doorway. In addition, the flexible edge strips which meet at the center of the doorway provide an effective seal and eliminate problems associated with overlapping door panels as used in the past.

As the resilient panels are clamped to the rails along the entire length of the panel edge, a more secure attachment is achieved, as opposed to an attachment in which fasteners are employed at spaced intervals.

Various types and thicknesses of panels can be employed without changing the rail construction and this provides greater versatility of use for the doors.

Various modes of carrying out the invention are contemplated as being within the scope of the following claims particularly pointing out and distinctly claiming the subject matter which is regarded as the invention.

I claim:

1. A traffic door to be mounted in a doorway and comprising a frame, means for mounting the door for swinging movement between an open and a closed position, a panel carried by the frame, an edge seal strip connected to a vertical edge of the panel, said strip being generally U-shaped in cross section and including a central generally flexible section and a pair of substantially rigid arms extending outwardly from the central section and disposed in engagement with opposite sides of the panel, said arms having serrations on the surfaces thereof facing the panel, and locking means connected to said arms and located between the flexible section and the panel, said locking means including cooperating male and female locking elements with said elements having cooperating ratchet type teeth.

2. A traffic door to be mounted in a doorway, comprising a frame, means for mounting the door for swinging movement between an open and closed position, said frame including a rail having a longitudinally extending recess and said rail having opposed inclined surfaces bordering said recess, a panel having an edge portion disposed within said recess, a pair of clamping members disposed within the recess on opposite sides of the panel to clamp the panel to said rail, each of said clamping members having an inclined surface cooperating with one of the inclined surfaces of the rail to thereby wedge the clamping members into tight bearing engagement with the panel as the clamping members are moved inwardly of said recess and a plurality of fasteners for connecting the clamping members to the rail.

3. The traffic door of claim 2, wherein the surface of each clamping member facing the panel is provided with a series of teeth to engage the panel.

4. The traffic door in claim 2, wherein the inclined surface of said rail is interrupted by a groove and the inclined surface of each clamping member is interrupted by a groove, said grooves adapted to be in mating relation when the clamping members are secured within said recess.

5. The traffic door of claim 2, wherein said rail is provided with a second longitudinal recess disposed opposite said first longitudinal recess, a strip enclosing said second recess, and a flexible member extending outwardly from said strip and adapted to engage the doorway to provide a weather seal between the door and the doorway.

6. The traffic door of claim 5, and including a pair of flexible members disposed in spaced relation on said strip.

7. The traffic door of claim 5, wherein said rail is provided with a pair of spaced flanges which define said second recess, said strip having a generally U-shape and including a web portion and a pair of flanges disposed in lapping relation with the flanges of said rail, a plurality of resilient blocks disposed between the rail and the web portion of the strip, and fastening means extending through said block and connecting the strip to said rail.

* * * * *